US011338186B2

(12) United States Patent
Welsh

(10) Patent No.: US 11,338,186 B2
(45) Date of Patent: May 24, 2022

(54) GOLF SWING TRAINING DEVICE

(71) Applicant: Steven Thomas Welsh, St Helens (GB)

(72) Inventor: Steven Thomas Welsh, St Helens (GB)

( * ) Notice: Subject to any disclaimer, the term of this patent is extended or adjusted under 35 U.S.C. 154(b) by 0 days.

(21) Appl. No.: 17/059,014

(22) PCT Filed: May 16, 2019

(86) PCT No.: PCT/GB2019/051347
§ 371 (c)(1),
(2) Date: Nov. 25, 2020

(87) PCT Pub. No.: WO2019/229417
PCT Pub. Date: Dec. 5, 2019

(65) Prior Publication Data

US 2021/0228960 A1 Jul. 29, 2021

(30) Foreign Application Priority Data

May 31, 2018 (GB) ..... 1808924

(51) Int. Cl.
*A63B 69/36* (2006.01)
*A63B 69/00* (2006.01)

(52) U.S. Cl.
CPC ..... *A63B 69/3608* (2013.01); *A63B 69/0059* (2013.01); *A63B 2225/09* (2013.01)

(58) Field of Classification Search
CPC ..... A63B 69/0059; A63B 69/3623; A63B 2225/09
USPC ..... 473/206, 207, 212–215, 266, 269, 276, 473/277, 409
See application file for complete search history.

(56) References Cited

U.S. PATENT DOCUMENTS

| | | | | |
|---|---|---|---|---|
| 1,699,219 | A | 1/1929 | Bemish et al. | |
| 2,093,153 | A * | 9/1937 | Mccarthy | A63B 69/0059 473/212 |
| 2,808,267 | A * | 10/1957 | Heaton | A63B 69/0059 473/212 |
| 3,679,214 | A * | 7/1972 | Boyte | A63B 69/0059 473/212 |
| 4,895,373 | A * | 1/1990 | Richmon | A63B 69/0059 473/215 |
| 5,665,015 | A * | 9/1997 | Clark, III | A63B 69/0059 473/213 |
| 5,704,856 | A * | 1/1998 | Morse | A63B 21/0004 473/212 |
| 5,951,408 | A | 9/1999 | Inman | |
| 6,196,931 | B1 * | 3/2001 | Wilt | A63B 69/0059 473/207 |
| 6,767,290 | B1 | 7/2004 | Tan | |

(Continued)

FOREIGN PATENT DOCUMENTS

| | | | |
|---|---|---|---|
| GB | 2129692 | A | 5/1984 |
| WO | 2017066820 | A1 | 4/2017 |

OTHER PUBLICATIONS

International Search Report for corresponding PCT application No. PCT/GB2019/051347, dated Aug. 14, 2019.

(Continued)

*Primary Examiner* — Nini F Legesse
(74) *Attorney, Agent, or Firm* — Notaro, Michalos & Zaccaria P.C.

(57) ABSTRACT

A golf swing training device for regulating the distance of the elbow of the dominant arm from the side of the body of a user during a golf swing.

12 Claims, 6 Drawing Sheets

(56) References Cited

U.S. PATENT DOCUMENTS

| | | | | |
|---|---|---|---|---|
| 6,832,960 | B2 * | 12/2004 | Thony | A63B 69/3608 473/277 |
| 10,688,361 | B2 * | 6/2020 | Cottam | A63B 69/0059 |
| 2018/0311556 | A1 * | 11/2018 | Cottam | A63B 69/0059 |

OTHER PUBLICATIONS

United Kingdom Search Report for corresponding GB application No. GB1808924.3, dated Oct. 26, 2018.

* cited by examiner

GOLF SWING TRAINING DEVICE

TECHNICAL FIELD OF THE INVENTION

The present invention relates generally to a golf swing training device. In particular, the present invention relates to a golf swing training device that is adapted to regulate the distance of the elbow of the dominant arm from the side of the body of a user, during a golf swing.

BACKGROUND TO THE INVENTION

Golfers, both amateur and professional are continually looking to improve and ingrain the execution of the golf swing. Improvement in swing mechanics is one specific component in which "muscle memory" is of significant importance. A correct repetitive action can encourage the development of muscle memory and provide familiarity of the physical feedback sensations present in a correct swing action.

One of the most common swing faults found in golf is known as "the flying elbow". This fault encourages an out to in swing across the swing path of the golf club and mainly results in a slice action being imparted onto the ball. With reference to a right-handed golfer, this results in the ball going to the right of the target line. Similarly, the same would apply in reverse for a left-handed golfer.

It is known in the art to provide training devices designed to hold the arm of a golfer close to the body throughout the back swing, through the use of a training device comprising an arm restraint, capable of looping around the arm of a user, and a shoulder strap assembly. Training devices for such use are described in, for example, U.S. Pat. Nos. 3,679,214, 5,951,408, 6,767,290, 2,093,153 and GB2129692.

U.S. Pat. No. 3,679,214, for example, relates to a training aid for a golf player designed to hold the elbow of the right arm close to the body throughout the back swing. The device comprises a waist belt; a front cross belt, the front cross belt being attached to the waist belt and secured around the right arm of the player just above the elbow; and a shoulder strap secured around the right shoulder and attached to the waist belt.

However, a number of issues have been observed in this device. Firstly, the arm restraint assembly is disadvantageously secured around the arm above the elbow. This requires continuous readjustment of the arm restraint, to prevent the strap riding up the arm of the user when in use. Additionally, the device requires a waist belt which disadvantageously restricts mobility around the core throughout the swing. Further, the adjustability means of the shoulder strap is positioned at the back of the user. This prevents the user from finely adjusting the circumference of the shoulder strap whilst the device is fitted to the body. The device is also bulky and lacks portability, due to its construction. This prevents easy storage of the device in a golf bag. Furthermore, the design of the device does not allow it to be used by both right- and left-handed golfers, as it admits that the actual construction of the swing gruver described therein has to be reversed for left-handers.

Further, a number of issues have also been observed in the other cited prior art devices. These include the need for regular readjustment of the shoulder strap during prolonged use; the need for regular readjustment of the arm restraint, to prevent the strap riding up the arm of the user when in use; the need for modification of the device to facilitate use by both left and right handed golfers; the lack of portability due to the rigidity of the materials and construction; the presence of a shoulder strap hindering rotation of the shoulder of the non-dominant hand, thereby preventing the completion of an unrestricted full swing; and the insufficient correction of the elbow positioning at the top of the back swing, due to restraint of the arm instead of the elbow.

As such, there still remains a need for a golf swing training device that may be adjusted to accommodate any age, size, sex and handedness of golfer, and may be worn for prolonged periods of time, such as throughout the entirety of a practice round of golf, without providing significant discomfort, or requiring readjustment; a golf swing training device which may be interchangeably used by both left- and right-handed golfers without any modification; a training device capable of fine adjustability, to regulate the distance of the elbow of the dominant hand from the side of the body during the golf swing; a golf swing training device that possesses portability and sufficient flexibility to allow easy storage in a golf bag; a golf swing training device that allows an unrestricted full swing to be completed, whilst providing sufficient feel and sensation feedback to successfully condition the muscular movement patterns of a correct swing; and further, a golf swing training device which fully ensures that the elbow adopts the correct movement path and positioning throughout all motions of the swing.

SUMMARY OF THE INVENTION

According to a first aspect of the present invention, there is provided a golf swing training device comprising a shoulder strap assembly, an elbow restraint assembly and a connecting strap member, configured to regulate the distance of the elbow of the dominant hand of a user from the side of the body, by resiliently biasing said elbow against the side of the body of the user, wherein the elbow restraint assembly comprises two stretchable bands, being adaptable for receiving the elbow of the dominant arm both above and below the elbow joint of the user.

By "dominant", it is meant herein the half of the body in which a person is generally stronger and shows preference for over the other.

It has been observed that the golf swing training device of the present invention is adapted to ergonomically complement the rotation and movements of the joints and torso throughout the duration of a golf swing. Advantageously, the ergonomic design and placement of the shoulder strap around the dominant shoulder and either side of the elbow joint of the user allows the joints and torso to work in such a way as to permit an unrestricted full swing to be completed, using the shoulder of the dominant hand as the anchor point. This enables sufficient muscular conditioning and kinaesthetic feedback throughout the full range of motion of the swing.

Further, the construction of the golf swing training device of the present invention allows increased portability and allows the device to be folded and fit comfortably within the hand. Advantageously, this allows easy storage of the device in golf bags or other compact locations. This facilitates use of the device at any time, such as during warm up, practice before games, or at the range.

It has been observed that the elbow restraint assembly of the present invention provides a comfortable fit and does not ride up the arm of the user during use. This allows continued use of the device without readjustment throughout the duration of a practice round. Furthermore, it has been observed that the use of two stretchable bands securable above and below the elbow joint increases support and further restricts outward movement of the dominant elbow, whilst still facilitating free movement around the joint. The placement of the elbow restraint assembly around the joint instead of the arm is more effective in restricting the movement path of the elbow during the swing, and more effectively forces the elbow to point towards the ground at the top of the backswing. This ensures a correct positioning, and provides a correct reference point for commencing the downswing.

Typically, the elbow restraint assembly is adjustable via an adjustable slide fastening means so that the circumference of each of the stretchable bands may be adjustable to the desired contours of the individual user's body. This ensures a comfortable fit and provides the greatest level of support and grasp around the joint of the user. In one embodiment of the present invention, the adjustable slide fastening means comprises a ladder lock buckle. However, other suitable fastening means will be apparent to the skilled person.

According to one embodiment of the invention, the aforementioned shoulder strap assembly comprises a shoulder loop, said shoulder loop being adaptable for receiving the shoulder of the dominant arm, said shoulder loop extending below the armpit and over the shoulder of the user.

It has been observed that the shoulder loop of the present invention ensures greater comfort and prevents any movement or slippage of the shoulder strap assembly during use. Single strap shoulder assemblies, as seen in the prior art, are prone to discomfort, movement and slipping from off the shoulder. This results in the need for constant readjustment throughout use.

Further, as mentioned previously, it has been observed that placement of the shoulder strap around the shoulder of the dominant hand allows an unrestricted full swing to be completed. The presence of a shoulder strap encompassing the shoulder of the non-dominant hand, as seen in a number of the prior art, restricts mobility around the non-dominant shoulder and prevents the completion of a full swing. This prevents the device from providing sufficient feel and sensation feedback throughout the full range of motion of the swing.

According to an embodiment of the invention, the shoulder strap assembly of the present invention comprises a further strap member, which typically extends diagonally across the front of the body, around the lateral edge of the mid-ribcage and diagonally across the back of the body, said further strap member being connected to said shoulder loop by a releasable connecting means.

The releasable connecting means is typically locatable on the front of the body. Advantageously, this allows the user to remove and fit the device easily.

The releasable connecting means typically comprises a side release buckle, although it will be appreciated that other releasable connecting means may be used in conjunction with the present invention without departing from the scope of the invention. Advantageously, the releasable connecting means ensures that the device may be easily and quickly removed and fitted to the body of the user.

The shoulder strap assembly of the present invention may be adjustable, typically via an adjustable slide fastening means. Typically, the adjustable slide fastening means is locatable on the front of the user's body. In a preferred embodiment of the present invention, said adjustable slide fastening means comprises a ladder lock buckle, although it will be appreciated that other adjustable fastening means may be used without departing from the scope of the invention. Advantageously, this will allow the shoulder strap assembly to adopt a preferred circumference dimension to accommodate the torso of a user of any age, size or sex. Additionally, positioning the adjustable fastening means on the front face of the user's body allows fine adjustability of the shoulder strap circumference whilst the device is fitted to the body and in use.

According to one embodiment of the invention, the golf swing training device further comprises a connecting strap member, wherein said connecting strap member extends horizontally across the front of the body, coupling said elbow restraint assembly with said shoulder strap assembly.

The connecting strap member directly couples the shoulder strap assembly and the elbow restraint assembly. Advantageously, this ensures that no waist band or securing means around the waist is required. This facilitates unhindered mobility and movement around the core throughout the swing.

Any suitable means to adhere a portion of the connecting strap member to the shoulder strap assembly may be used as desired or required. In a preferred embodiment of the invention, the connecting strap member is adhered to the shoulder strap assembly via a D ring. Typically, the D ring may be formed from metal, although it will be appreciated that other suitable materials may be used.

Again, it will be appreciated that the connecting strap member of the present invention will be adjustable, typically via an adjustable slide fastening means. In a preferred embodiment of the present invention, said adjustable slide fastening means comprises a ladder lock buckle, although other suitable fastening means will be apparent to the skilled person. Advantageously, this will allow the connecting strap member to adopt a preferred circumference dimension to ensure fine adjustability of the distance of the elbow of the dominant arm from the side of the body of the user.

The shoulder strap assembly, elbow restraint assembly and connecting strap member of the present invention may be formed from a material sufficiently flexible to contour around the body, but sufficiently strong enough to withstand the forces present during a golf swing. In addition, the material must be sufficiently strong to maintain sufficient tension in the connecting strap member, in order to sufficiently bias the elbow against the side of the body throughout the motion of the swing. Typically, this material may comprise any flexible material that may be shaped or fastened, such as leather, cotton, linen, flax, polypropylene and other woven plastics or fibres. Most typically, in a preferred embodiment of the present invention the material may comprise webbing.

Furthermore, the golf swing training device of the present invention is adapted for use by both left handed and right-handed golfers. Advantageously, this overcomes a number of issues present in the prior art wherein the training devices were unable to be interchangeably used by both right handed and left-handed golfers, without significant modification of the device.

According to a further aspect of the present invention, there is provided a method of developing a golf swing of a golfer comprising the steps of:

a) providing a golf swing training device comprising: a shoulder strap assembly, an elbow restraint assembly and a connecting strap member coupling said shoulder strap assembly to said elbow restraint assembly, wherein the connecting strap member is configured to regulate the distance of the elbow of the dominant arm from the side of the body throughout the swing by resiliently biasing said elbow against the side of the body, and wherein the elbow restraint assembly comprises two stretchable bands, being adaptable for receiving the elbow of the dominant arm of a user both above and below the elbow joint of the user;

b) placing said elbow restraint assembly around the elbow of the dominant arm;

c) placing said shoulder strap assembly around the shoulder of the dominant arm; and d) executing a golf swing.

DETAILED DESCRIPTION OF THE INVENTION

In order that the invention may be more clearly understood one or more embodiments thereof will now be described, by way of example only, with reference to the accompanying drawings, of which:

Figure 1:
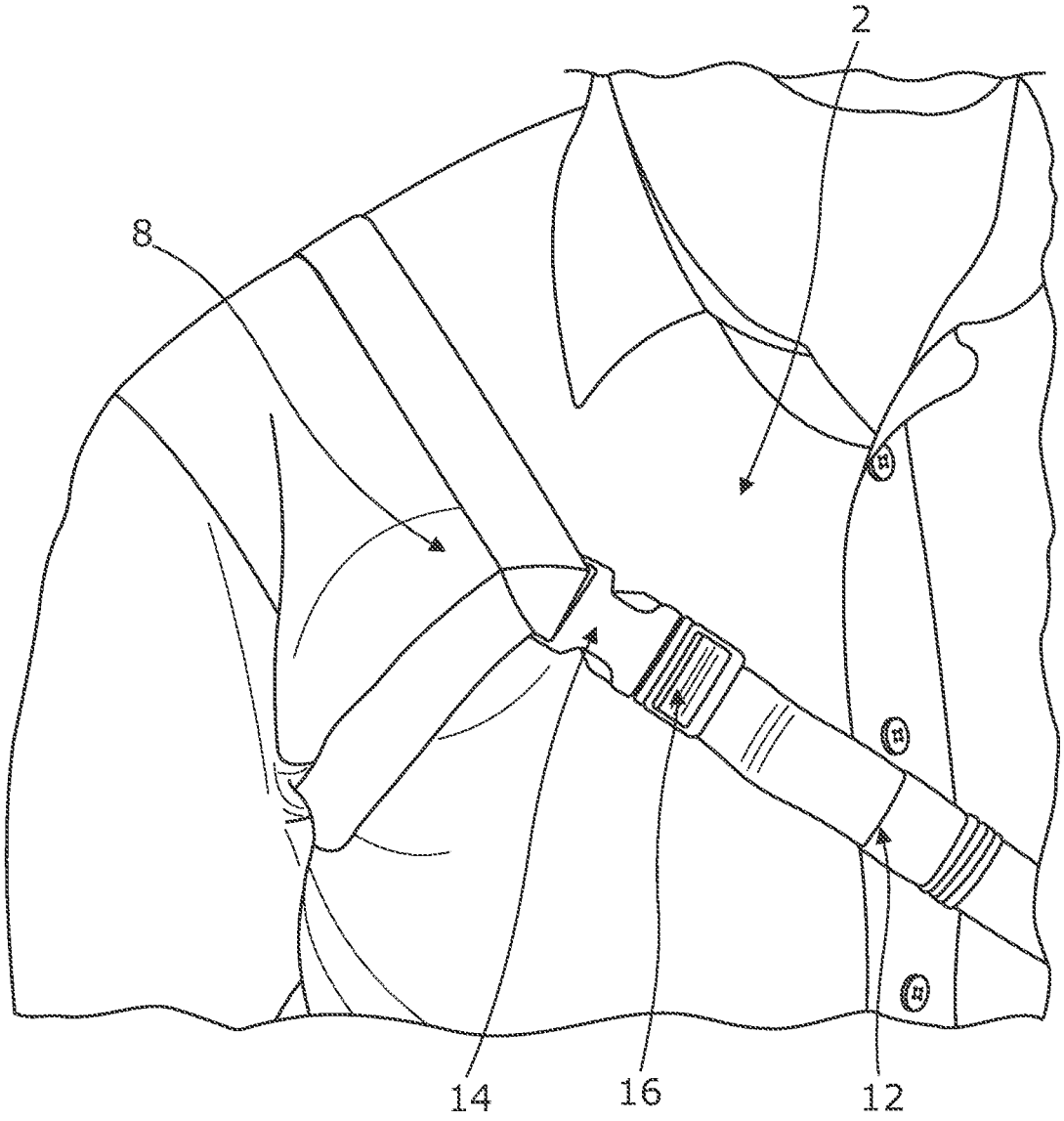
FIG. 1 is a front view of the shoulder loop of the shoulder strap assembly of the present invention.
Figure 2:
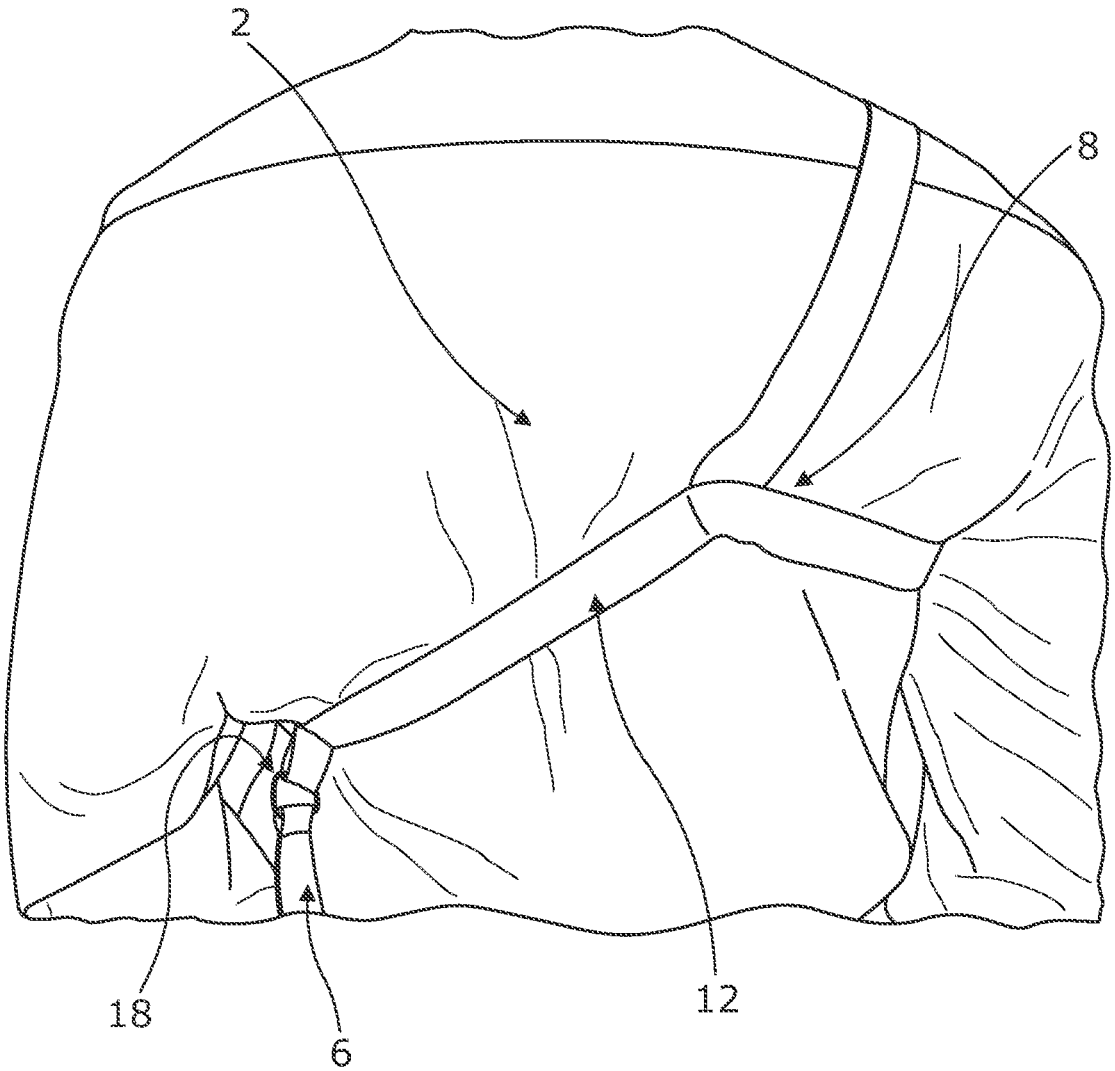
FIG. 2 is a back view of the shoulder strap assembly according to the present invention.

With reference to the drawings, the golf swing training device of the present invention comprises a shoulder strap assembly 2, an elbow restraint assembly 4, and a connecting strap member 6, extending horizontally along the front of the body, coupling the shoulder strap assembly 2 to the elbow restraint assembly 4.

The shoulder strap assembly 2 comprises a shoulder loop 8 which is adapted to be worn by the golfer around the shoulder of the dominant hand. For right-handed golfers, the shoulder loop 8 is worn around the golfer's right shoulder and similarly, for left-handed golfers the shoulder loop 8 is worn around the left shoulder. The shoulder strap assembly 2 comprises a further strap member 12 which is arranged to extend diagonally across the front of the body, around the lateral edge of the mid-ribcage and diagonally across the back of the body to the base of the shoulder loop 8, situated upon the rear shoulder blade of the dominant arm.

Suitable means for connecting the shoulder loop 8 to the further strap member 8 include a side release buckle 14 comprising a female end connected to the shoulder loop 8 and a male end connected to the further strap member 12.

At the male end of the side release buckle 14 there is included an adjustable slide fastener 16 attached thereto as shown in FIG. 1. In a preferred embodiment, the adjustable slide fastener 16 is locatable on the front of the user's body and comprises a ladder lock buckle 16. This adjustable slide fastener 16 allows adjustment of the circumference of the further strap member 12, so as to achieve the desired fit around the chest/upper torso.

Connected to the further strap member 12 at mid ribcage level on the opposite side to the dominant hand is a connecting strap member 6.

Figure 3:
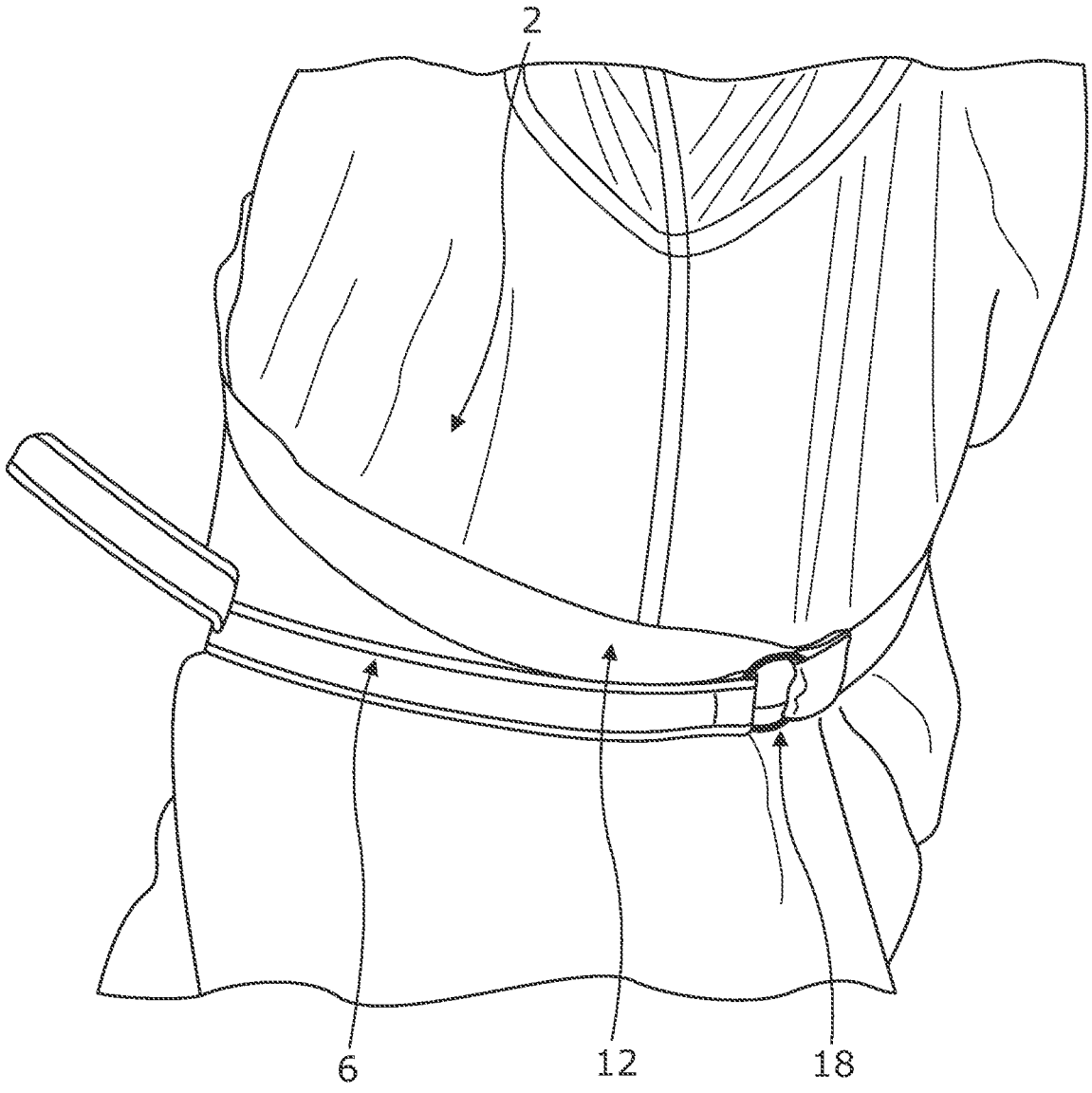
FIG. 3 is a lateral view of the shoulder strap assembly and connecting strap member, demonstrating their coupling, according to the present invention.
Figure 4:
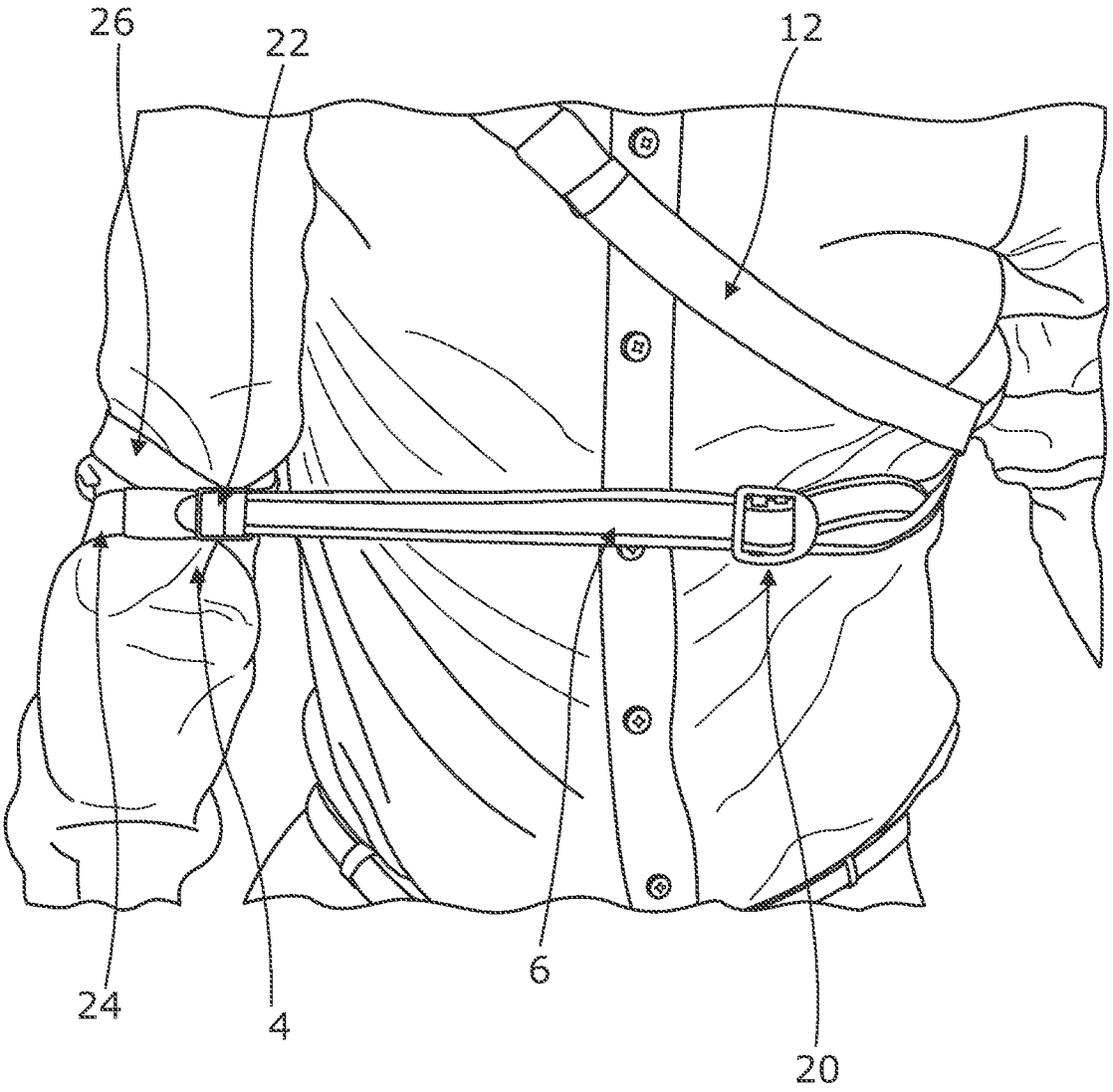
FIG. 4 is a front view of the elbow restraint assembly, connecting strap member and diagonal shoulder strap member of the shoulder strap assembly according to the present invention.
Figure 5:
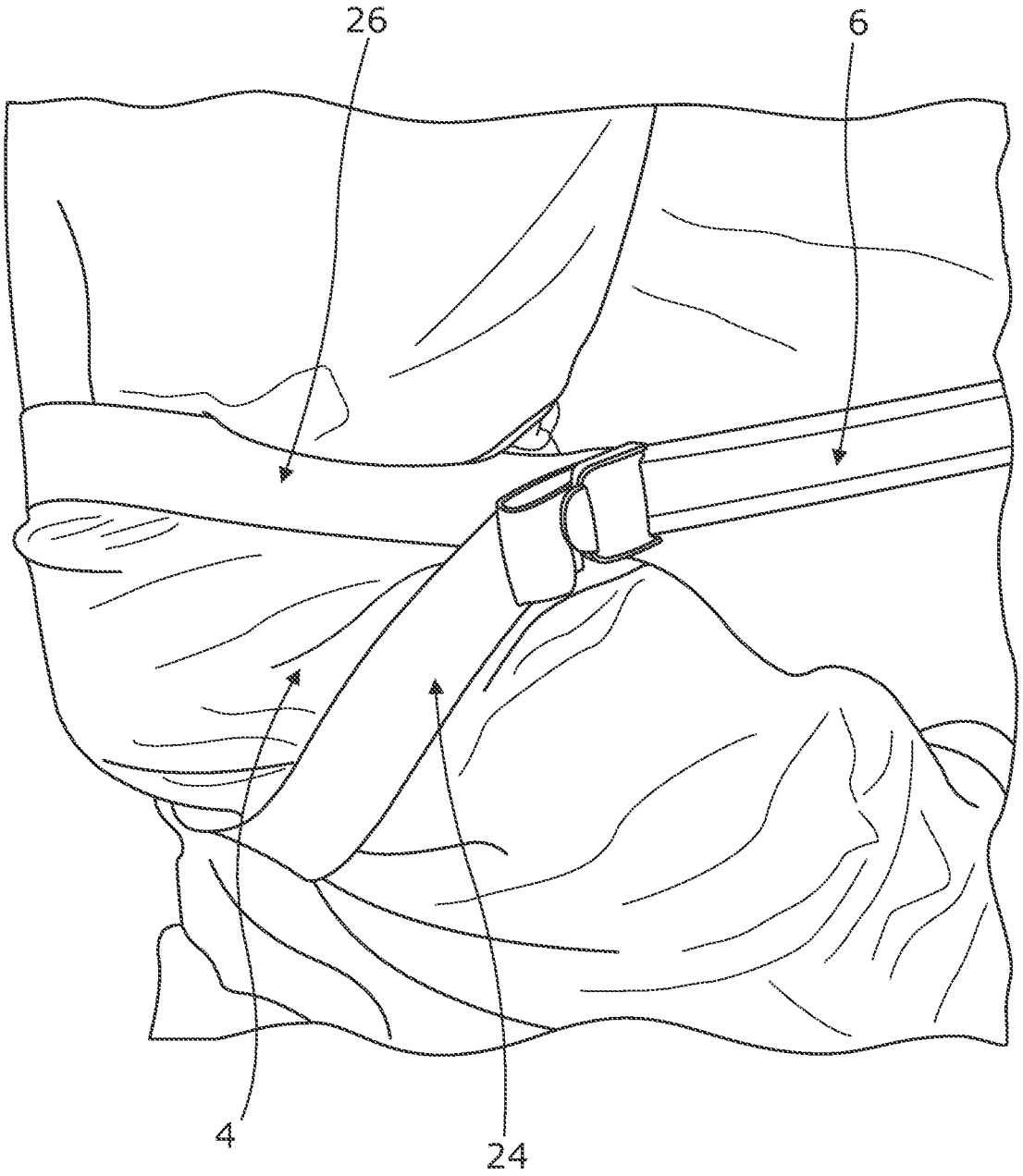
FIG. 5 is a lateral view of the elbow restraint assembly according to the present invention.
Figure 6:
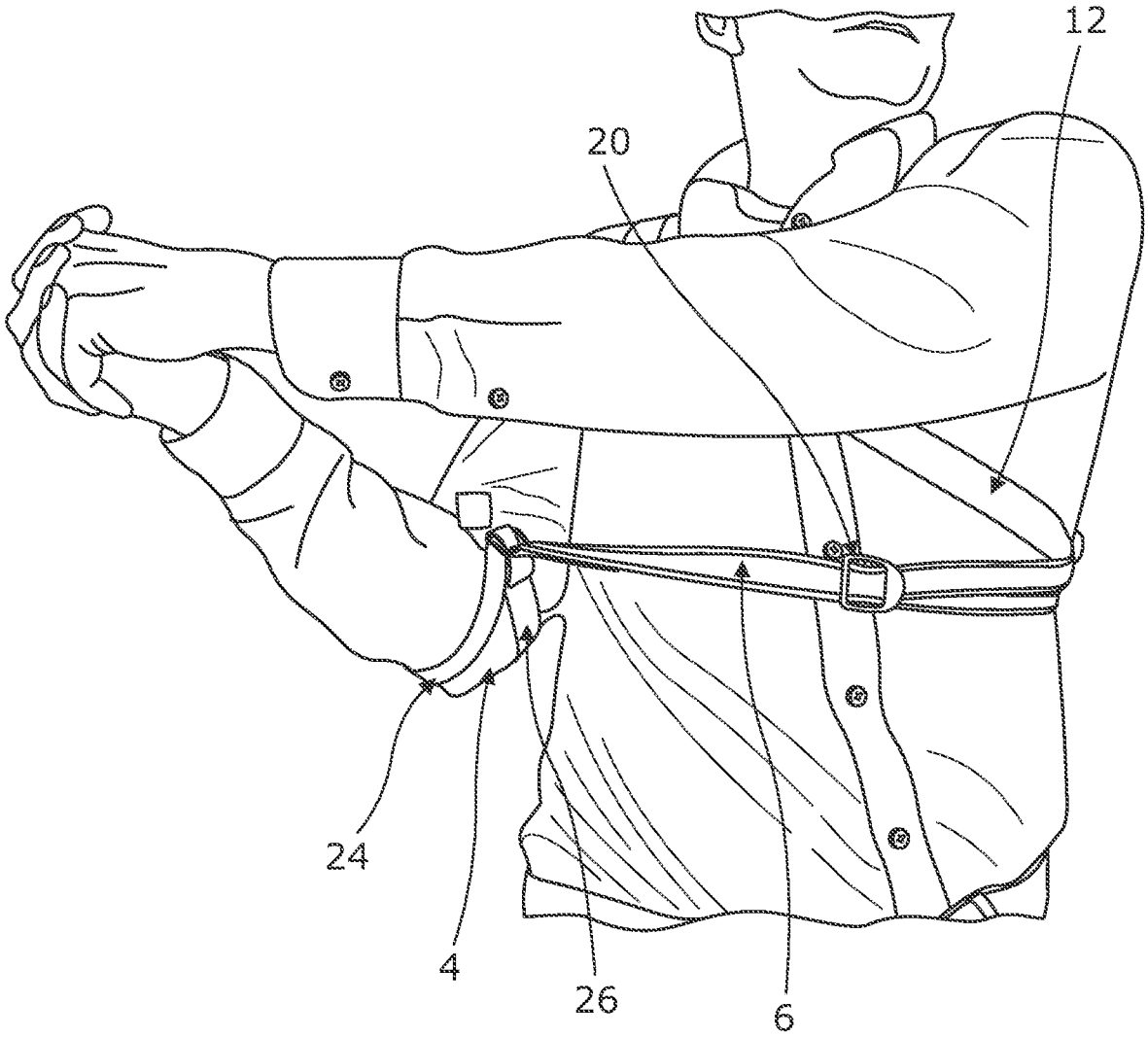
FIG. 6 is a front view of the training device of the present invention, in use by the golfer at the top of the backswing.

The connecting strap member 6 is connected to the further strap member 12 via a D-loop ring 18, as shown in FIG. 3. This adjoins the two strap members via looped ends, stitched onto the ends of the connecting strap member 6 and further strap member 12. The connection point occurs at the mid-ribcage level at the back of the body. This ensures that tension is created in the connecting strap member 6 as it is pulled tight to the contours of the body, wrapping around the lateral edge of the non-dominant ribcage and extending horizontally across the front of the body to the elbow restraint assembly 4.

The connecting strap member 6 comprises a band which extends horizontally across the body at mid ribcage level to an elbow restraint assembly 4 positioned around the elbow joint of the dominant arm. Further, the connecting strap member 6 is affixed to an adjustable slide fastener 20 that is slideable along an intermediate length of the connecting strap member 6. The length of the connecting strap member 6 is fully adjustable, to accommodate different size of person. In a preferred embodiment of the invention, this adjustable slide fastener 20 is a ladder lock buckle 20. Further, the length of the connecting strap member 6 may be adjustable to regulate the distance of the dominant hand from the side of the body during the swing.

The connecting strap member 6 is connected to the elbow restraint assembly 4 via a ladder lock buckle 22. This buckle 22 comprises three slots. One slot allows the connecting strap member to be threaded through, and the other two allow the stretchable bands of the elbow restraint assembly to be threaded through. This ensures the coupling of the elbow restraint assembly 4 and the connecting strap member 6.

The elbow restraint assembly 6 comprises two stretchable straps 24, 26 which cradle the elbow both above and below the joint, whilst also allowing freedom of movement around the joint throughout the swing. A first stretchable band 26 encompasses the circumference of the lower triceps, directly adjacent the elbow joint and threads through the ladder lock buckle 22 situated at the medial front face of the elbow joint. A second stretchable band 24 encompasses the circumference of the forearm, directly adjacent the elbow joint and again threads through the ladder lock buckle 22 situated at the medial front face of the elbow joint.

In operative use the training device is fitted upon the person and fully adjusted to the required dimensions. The elbow restraint assembly 4 is placed around the dominant arm and cradles the elbow both above and below the joint of the user. The shoulder strap assembly 2 is then secured around the torso and adjustably fitted to the user selected dimensions. The tension present in the connecting strap member 6 prevents any significant outward movement of the elbow of the dominant hand from the side of the body and resiliently biases the elbow thereto. Throughout the motion of the swing the biasing of the elbow of the dominant hand against the side of the body forces the elbow into a correct movement path and reinforces correct arm/body positioning at the top of the back swing, thereby providing a correct reference point for the start of the downswing. This prevents any out to in swing movement across the swing path.

After the device has been worn for a comparatively short period of time, muscular coordination will have been developed and the correct movement may be performed without conscious effort.

The above embodiments are described by way of example only. Many variations are possible without departing from the scope of the invention as defined in the appended claims.

The invention claimed is:

1. A golf swing training device comprising a shoulder strap assembly (2), an elbow restraint assembly (4) and a connecting strap member (6), configured to regulate a distance of an elbow of a dominant arm of a user from the side of a body, by resiliently biasing said elbow against the side of the body of the user, wherein an elbow restraint assembly (4) comprises two stretchable bands (24, 26), being adaptable for receiving the elbow of the dominant arm both above and below the elbow joint of the user, and wherein said shoulder strap assembly (2) comprises a shoulder loop (8), said shoulder loop (8) being adaptable for receiving a shoulder of the dominant arm.

2. A golf swing training device according to claim 1, wherein said shoulder loop (8) extends below an armpit and over the shoulder of the dominant arm of the user.

3. A golf swing training device according to claim 1, wherein said connecting strap member (6) is retained in a position in which it extends horizontally across in front of the body and couples said shoulder strap assembly (2) to said elbow restraint assembly (4).

4. A golf swing training device according to claim 1, wherein said shoulder strap assembly (2) comprises a further strap member (12), typically extending diagonally across in front of the body, around a lateral edge of the mid-ribcage and diagonally across a back of the body, said further strap member (12) connected to said shoulder loop (8) by a releasable connecting means (14).

5. A golf swing training device according to claim 4, wherein said releasable connecting means (14) comprises a side release buckle (14).

6. A golf swing training device according to claim 1, wherein said shoulder strap assembly (2), elbow restraint assembly (4) and connecting strap member (6) comprises any flexible material that is able to be shaped or fastened.

7. A golf swing training device according to claim 6, wherein the flexible material comprises leather, cotton, linen, flax, polypropylene and other woven plastics or fibres; optionally the material comprises webbing.

8. A golf swing training device according to claim 1, wherein said shoulder strap assembly (2), elbow restraint assembly (4) and connecting strap member (6) are adjustable to a user selected circumference.

9. A golf swing training device according to claim 8, wherein said shoulder strap assembly (2), elbow restraint assembly (4) and connecting strap member (6) are adjustable to a user selected circumference by an adjustable slide fastening means (16, 20, 22).

10. A golf swing training device according to claim 9, wherein said adjustable slide fastening means comprises a ladder lock buckle (16, 20, 22).

11. A golf swing training device according to claim 1, wherein the device is available for use by both left-handed and right-handed golfers without modification.

12. A method of developing a golf swing of a golfer comprising the steps of:

a) providing a golf swing training device comprising: a shoulder strap assembly (2), an elbow restraint assembly (4) and a connecting strap member (6) coupling said shoulder strap assembly (2) to said elbow restraint assembly (4), wherein the connecting strap member (6) is configured to regulate a distance of an elbow of a dominant arm from a side of a body throughout the swing by resiliently biasing said elbow against the side of the body, and wherein the elbow restraint assembly comprises two stretchable bands (24, 26), being adaptable for receiving the elbow of the dominant arm of a user both above and below an elbow joint of a user;

b) placing said elbow restraint assembly (4) around the elbow of the dominant arm;

c) placing said shoulder strap assembly (2) around the shoulder of the dominant arm and torso of the user; and d) executing a golf swing.

* * * * *